US006820447B2

(12) United States Patent
Thies et al.

(10) Patent No.: US 6,820,447 B2
(45) Date of Patent: Nov. 23, 2004

(54) FOREIGN OBJECTS TRAP FOR AN AUTOMATIC WASHER

(75) Inventors: Edward L. Thies, Creola, OH (US); Matthew C. Parsons, Dowagiac, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 372 days.

(21) Appl. No.: 10/141,293

(22) Filed: May 8, 2002

(65) Prior Publication Data

US 2003/0209041 A1 Nov. 13, 2003

(51) Int. Cl.[7] ..... D06F 37/00

(52) U.S. Cl. ..... 68/18 R; 68/18 F; 68/208; 210/532.1

(58) Field of Search ..... 68/3 R, 15, 13 R, 68/18 R, 18 F, 208; 134/111, 110, 105; 210/187, 196, 521, 532.1

(56) References Cited

U.S. PATENT DOCUMENTS

| | | | | | |
|---|---|---|---|---|---|
| 3,228,525 | A | * | 1/1966 | Evans et al. | 210/167 |
| 3,681,947 | A | * | 8/1972 | Cowan | 68/18 F |
| 3,684,096 | A | * | 8/1972 | Kretchman | 210/356 |
| 3,727,435 | A | * | 4/1973 | Menk | 68/18 F |
| 3,738,126 | A | * | 6/1973 | Smith | 68/18 F |
| 4,066,094 | A | * | 1/1978 | Stitch | 137/387 |
| 4,198,717 | A | * | 4/1980 | Kessel | 4/286 |
| 4,263,138 | A | * | 4/1981 | Kessel | 210/163 |
| 4,357,812 | A | * | 11/1982 | Braga et al. | 68/18 D |
| 4,485,645 | A | | 12/1984 | Mulder et al. | 68/18 F |
| 4,580,421 | A | * | 4/1986 | Babuin et al. | 68/12.13 |
| 4,637,230 | A | * | 1/1987 | Roberts | 68/4 |
| 4,833,900 | A | | 5/1989 | Babuin et al. | 68/18 F |
| 5,868,011 | A | * | 2/1999 | Hawkins et al. | 68/208 |
| 6,269,666 | B1 | | 8/2001 | Whah et al. | 68/12.02 |
| 6,584,812 | B1 | * | 7/2003 | Killane | 68/18 F |

FOREIGN PATENT DOCUMENTS

| | | |
|---|---|---|
| DE | 1585818 | * 10/1971 |
| DE | 1710562 | * 11/1971 |
| DE | 195 37 944 | * 4/1997 |
| FR | 2818671 | * 6/2002 |
| JP | 11-269959 | * 10/1999 |
| JP | 2000-192522 | * 7/2000 |

OTHER PUBLICATIONS

European Patent Office 665,320 Oct. 1998 (Herve).*

* cited by examiner

*Primary Examiner*—Frankie L. Stinson
(74) *Attorney, Agent, or Firm*—John F. Colligan; Robert O. Rice; Stephen Krefman

(57) ABSTRACT

A foreign objects trap is provided for an automatic washer, wherein the washer has a wash tub with an outlet leading to a recirculation pump and drain pump. The trap comprises a container having a water inlet in communication with said tub outlet for defining an initial flow path for water from said wash tub into said container. The trap also includes a first wall positioned in an impact orientation relative to the initial flow path downstream of said inlet, at least one quiet zone downstream of the first wall, at least one baffle downstream of the quiet zone, the baffle extending substantially perpendicular to a direction of flow of said water, an outlet leading to the drain pump downstream of the baffle, and an outlet leading to the recirculation pump downstream of the baffle. A heater can be inserted in the trap as can an air dome and pressure sensor. A second quiet zone and baffle, between the first baffle and the outlets may also be provided.

22 Claims, 3 Drawing Sheets

FOREIGN OBJECTS TRAP FOR AN AUTOMATIC WASHER

BACKGROUND OF THE INVENTION

The present invention relates to automatic washers and in particular to a trap for foreign objects in a washer.

In automatic clothes washers it is preferred that only fabric materials be placed into the wash zone of the wash tub, however, other objects make their way into the wash zone including buttons, keys, stones and pebbles, small metal objects, etc. which can cause damage to the pumps used in the automatic washers such as the recirculation pump and the drain pump.

In some washers it is desirable to use motors such as synchronous motors to drive the recirculation pumps. These types of motors have relatively low efficiency and low torque, but also low cost. Flow rates through these recirculation pumps are maximized by maintaining a close relationship between the impeller and the pump housing. These factors make this type of pump very susceptible to problems caused by foreign materials. Foreign materials are easily trapped between the impeller and housing because of the close relationship. Low torque of the driving motor causes the trapped materials to completely stop the pump.

Collecting and holding foreign materials can cause a number of problems. Collective materials can eventually reduce flow rates by obstructing water flow path. Some collected materials deteriorate with time and may be redistributed on clothing or cause odor. Other types of materials may add to the accumulation process by causing materials to accumulate that might otherwise be pumped down the drain.

A foreign objects trap is disclosed in U.S. Pat. No. 4,485,645 in which a container is provided which has a water inlet in communication with a tub outlet. The water inlet terminates just short of a floor of the container and the water is then required to pass up through a plate which has irregularly shaped tubes therethrough for preventing passage of foreign objects. Lint is specifically permitted to pass through the foreign objects trap and all of the water exits from the container through a single outlet leading to a single pump which is utilized to both recirculate water and drain water, depending upon the position of a valve located downstream of the pump. Thus, this foreign objects trap has a disadvantage of allowing lint to be recirculated onto the clothes load and also accommodates only a single pump.

U.S. Pat. No. 4,833,900 discloses a foreign objects filter for an automatic water through which all of the water from the wash tub is directed. In an embodiment, one part of the filter comprises a fine mesh filter and the outlet of that portion leads to the recirculation pump. The other side of the filter has a coarse mesh and its outlet leads to the drain pump. In a second embodiment, only a coarse filter is provided whose outlet leads to either the recirculation pump and the drain pump. This device permits the passage of small, but heavy objects, such as nails and screws to the drain pump, potentially causing damage to that pump.

SUMMARY OF THE INVENTION

The present invention provides a system that allows a drain pump to pass as much foreign material down the drain as possible, other than very dense objects yet prevents a large portion of the foreign material from entering the recirculation pump.

The present invention, in an embodiment, provides a container separated from, but connected to the tub, perhaps with a hose. Both the drain and the recirculation pumps are commonly mounted to this container. The container is designed to allow some foreign objects, such as toothpicks and lint, to pass through to the drain pump which is capable of handling normal quantities of these materials without a problem due to its higher torque motor and larger clearances within the pump. The container is designed to prevent heavier and denser foreign objects such as screws, nails, curtain hooks, metal chains, etc. from reaching either the drain or recirculation pump. The container also incorporates a filter mechanism designed to prevent certain amounts of lint and other light objects from entering the recirculation pump. This is important for two reasons. First, it is not desirable to allow lint to be recirculated over clothes and second, a low cost recirculation pump can handle only small quantities of lint, as explained above. The filter mechanism is also designed and oriented to allow lint collected during the operation of the recirculation pump to be removed from the filter mechanism when the drain pump is operated, thus automatically cleaning the filter.

In an embodiment of the invention, a platform is provided directly below, in close proximity with, and extending completely beyond the wash liquid inlet from the hose which is connected to the tub. The wash liquid may be comprised mainly of water, with detergents and other additives, or may be a non-aqueous liquid. The term "water" as used herein is meant to include all wash liquids, whether or not they actually contain water. The close proximity of the platform, as well as its orientation of being substantially perpendicular to the water flow through the inlet, causes heavier foreign objects to impact the platform as they are moved along with the water. This makes them lose some of their kinetic energy. The platform then drops down creating an area that is relatively stagnate in which the heavy foreign materials fall and are held. It is likely that some heavy foreign materials can be carried along with the water in spite of hitting the platform. A baffle is provided causing further obstruction to heavy objects that may not have been trapped. The baffle extends upwardly from the floor of the trap with an opening near the top dimension to allow water to easily flow. A second baffle may be provided further downstream for the same purpose. The top of each baffle preferably is higher than the platform, so energy loss from hitting the platform will likely not allow a heavy foreign object to reach the top of the container. Designed as described, most heavy foreign objects will be trapped, while lighter foreign objects easily pass over the baffles to the drain and are disposed down the drain pipe.

During operation of the recirculation pump, heavy foreign objects are easily trapped because of the reduced flow rate. Lighter objects such as lint can still move with the water flow to the pump, so it should be protected from these materials. An obstruction wall is provided in front of the inlet to the recirculation pump. This wall has two purposes. The wall prevents the trapped heavy foreign objects from entering the recirculation pump inlet and it provides obstruction to reverse flow through the recirculation pump when the drain pump is operating. Reverse flow through the recirculation pump can cause air to be pulled into the system. This reduces drain flow and can cause unwanted noise. Another smaller wall is provided between the drain pump inlet and the recirculation obstruction wall. Since it is desired that lighter foreign objects be allowed to travel to the drain pump inlet chamber, they must be prevented from entering the recirculation from this chamber making the smaller wall necessary. The only water flow path to the recirculation pump is therefore over the top of the baffle walls. It is possible for large amounts of lint and toothpicks to pass over the baffle walls and enter the recirculation pump, so a series of fins in the lid of the trap are incorporated as the smaller wall and act as a filter mechanism. When the lid is assembled, these fins make contact along the top and sides of the walls. The fins are specifically designed with dimensions that prevent toothpicks from getting into the recirculation pump. The dimensions further allow certain amounts of lint to pass to the recirculation pump while larger amounts tend to wrap around the fins. This reduces openings to the recirculation pump causing more lint to be collected by the filter, thus preventing lint from being recirculated while protecting the pump from obstruction. The fins are oriented in shape so that the lint is automatically pulled off of the fins when the drain pump is activated, thus providing a self cleaning of the filter.

The lid might also be designed to integrate an air dome with pressure sensors directly mounted above the air dome. Since the trap/filter is hydraulically connected to the tub, the sensors can be used to determine water levels or a possible flood condition. Integrating these devices further reduces cost for this function.

A further advantage of utilizing a remote sump is to provide heat to the water flowing through the sump. The use of a heater to raise water temperature in an automatic washer is not new. It is normally accomplished by providing the tub with a sump and then mounting a calrod heater in the sump area. It has become desirable to reduce water usage in machines and as water levels are reduced, heating water becomes more important. Tap water from the inlet may be heated as it enters the machine, but it loses much of its thermal energy due to a cold basket, tub and clothes.

One of the methods of washing clothes which is employed to reduce water consumption and/or improve performance without additional water, is the "catalyst" portion of a wash cycle. The "catalyst" portion of a cycle usually takes place during the initial fill where small amounts of water are added to provide a more concentrated detergent to help remove stains and soils. The reduced water will not be an amount sufficient to cover the clothes, so it must be recirculated over the clothes with a pump. Since only a small amount of water is used during the initial fill, and due to the fact that the clothes, the basket and the tub will be cold during this period, benefits of any thermal energy during "catalyst" becomes almost insignificant. Thermal energy can be re-gained by incorporating a heater into the wash system. A sump heater has a draw back that because of the smaller amounts of water during "catalyst" the heater could become uncovered, resulting in the heater sheath becoming extremely hot. It is therefore necessary to add enough water to ensure the heater will be covered, which will dilute the desired detergent concentration, as well as increase in water usage. If the depth of the sump is small, in order to minimize water and increase detergent concentration, the water level in the sump may be in close proximity to the basket. The close proximity of the sump water then causes concern for "suds lock" a condition when heavy suds can touch the basket, increasing forces necessary to drive or spin the basket.

The total sump volume of a machine might be considered to be the volume of the tub sump plus the volume of any remote sump. Since part of the water to feed the inlet of the recirculation pump is in the remote sump, the volume of the tub sump can be reduced by a like amount. In fact, the only remaining purpose of the tub sump is to provide an area to hold water that might be needed to cover a heating element if one is used. There are, however, benefits in the eliminating the tub sump altogether in favor of a remote sump with an integral heater. The remote sump can be designed to house a cal-rod heating element and associated temperature sensor. If this is done, the element could be located in the remote sump container such that is it below the inlet to recirculation pump as well as the drain pump. Both pumps would be air locked and stop pumping should the water level be reduced below the highest point of their inlets. With the heater below this point, it essentially becomes impossible that the heater will become uncovered except through evaporation or leakage. It is further possible that a film heater can be molded into or become the bottom of a remote sump allowing it to retain its compact features while still incorporating the heater. In addition to these advantages, total water height, and therefore its proximity to the basket during "catalyst", can be lower within the system, reducing or eliminating the possibility of suds lock.

A film heater may be described as a substrate on which a resistive element is printed by silk screen or other similar process into a desired pattern. These devices are widely available and may include temperature sensors also printed as a part of the device. The substrate may be made of a flexible high temperature plastic or ceramic. Substrates may also be stainless steel with a layer of insulation material printed on the steel before the resistive material is printed. The substrate material may also be metal with a porcelain layer covering the metal to which the resistive layer is printed.

DETAILED DESCRIPTION OF THE PREFERRED EMBODIMENT

The present invention relates to a trap for foreign objects to be used in conjunction with an automatic clothes washing machine. Any type of configuration of clothes washing machine can utilize the trap of the present invention, whether that washing machine is a vertical axis machine, a horizontal axis machine, a tilted axis machine, a machine with a wobble plate, an impeller, or any other clothes moving arrangement.

In any type of clothes washing apparatus, an object of the apparatus is to remove dirt, odors, stains and other materials from the fabric being cleaned. Oftentimes this results in the removal or separation of various foreign objects which have been carried along with the fabric load. In any type of automatic washing appliance it would be useful to have an arrangement for segregating and removing such objects from the wash liquid, which is provided by the present invention.

Figure 1:
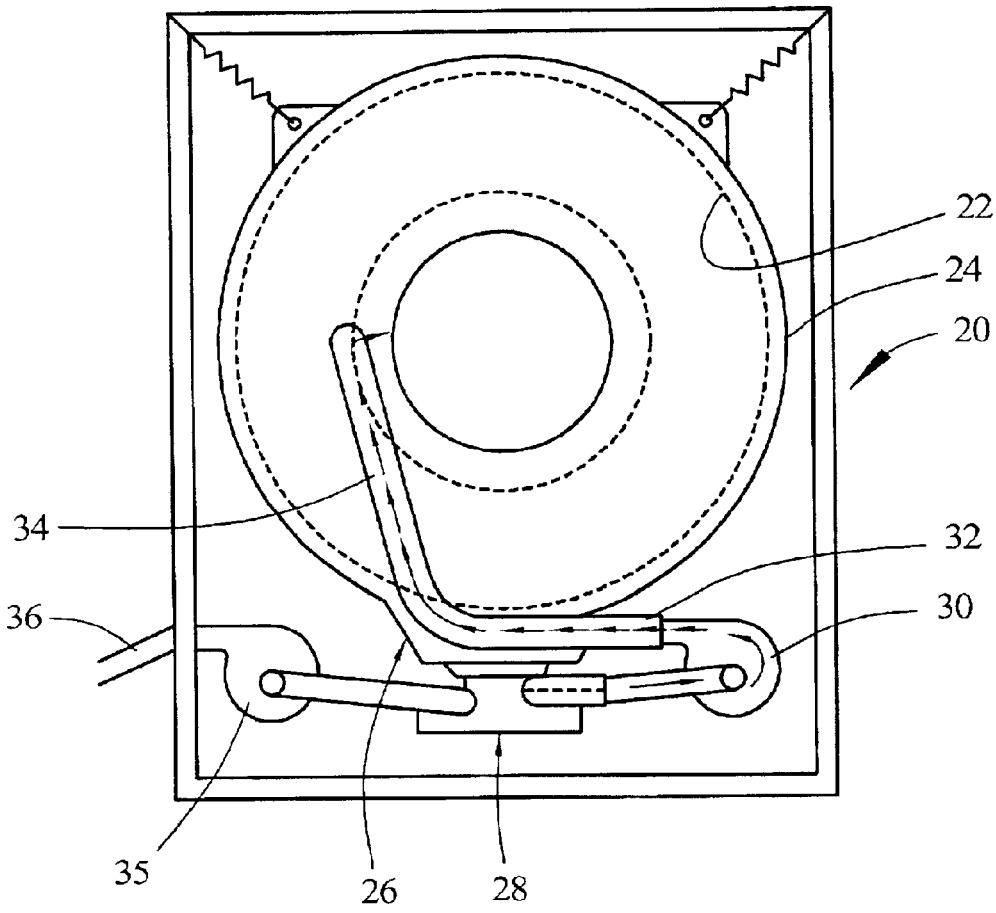
FIG. 1 is a perspective view of an automatic washer embodying the principles of the present invention.

Merely as an illustrative example, FIG. 1 illustrates an automatic washer 20 which is of a horizontal axis rotating type having a rotatable wash drum 22 carried inside of a wash tub 24. At the lower end of the wash tub 24 is a sump 26 where wash liquid collects and which then passes into a foreign objects trap 28. The wash liquid then continues to a pump 30 for recirculation to the wash tub 24 through a recirculating conduit 34 or to a pump 35 be directed to a drain conduit 36. The drain conduit 36 may lead to a drain to dispose of the wash liquid, or may lead to a tank or other reservoir where the wash liquid is collected before being treated and reused in the washer 20.

Figure 2:
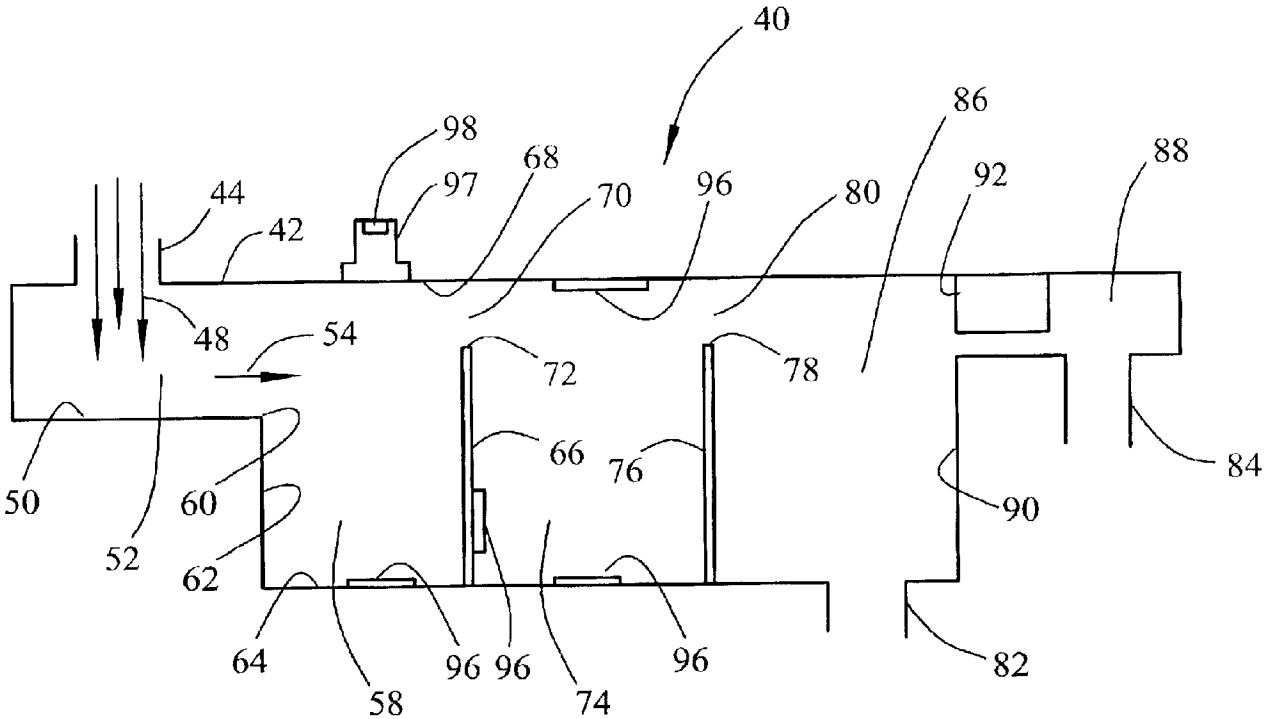
FIG. 2 is a schematic illustration of a foreign objects trap embodying the principles of the present invention.

FIG. 2 schematically illustrates a foreign objects trap 40 embodying the principles of the present invention. The foreign objects trap 40 is comprised of a container 42 having an inlet 44 which communicates with the wash tub 34. As described below, it is not necessary for the wash tub to be provided with a separate sump, however, the outlet from the wash tub 24 which connects to the inlet 44 should be positioned at a lowermost point in the wash tub in order to effect complete draining of wash liquid from the wash tub.

The inlet 44 defines an initial flow path 48 for liquid from the wash tub 24 into the foreign objects container 42. A first wall 50 is positioned in an impact orientation relative to the initial flow path 48, such as by being substantially perpendicular to the initial flow path and closely adjacent to and downstream of the inlet 44, with this arrangement the wash liquid, and any foreign objects carried along therewith, will impact the wall 50, thereby reducing some of the kinetic energy of the foreign objects which are carried along with the liquid stream.

The wall 50 forms a portion of an inlet chamber 52 which includes the inlet opening 44. After the wash liquid strikes the wall 50, the flow path is diverted to a direction 54 substantially parallel to the impact wall 50. Downstream of the wall 50 and inlet chamber 52 is a quiet zone 58 which may be defined, at one side, by an end 60 of the wall 50. The quiet zone 58 may have a cross sectional area, perpendicular to the new flow path 54, which is greater than a cross sectional area of the inlet chamber 52, perpendicular to the flow path 54, such that the velocity of the wash liquid passing through the quiet zone 58 will be substantially reduced. The quiet zone 58 may also have a greater depth than the inlet chamber 52, such as provided by a vertical wall 62 leading to a floor 64 forming a bottom wall of the container 42. Heavy foreign objects, no longer carried along by the slower flowing wash liquid, will drop to the floor 64 as the liquid stream passes from the inlet chamber 52 to the quiet zone 58.

A baffle 66 is provided downstream of the quiet zone 58 and, in the embodiment illustrated, forms a downstream edge of the quiet zone. The baffle 66 may extend upwardly from the floor 64 and terminate short of a top wall of the container, thus defining a passage 70 leading from the quiet zone 58. Preferably a top end 72 of the baffle 66 has a higher elevation than the wall 50 further reducing the likelihood that heavy and dense objects would be carried through the passage 70 since their kinetic energy was reduced upon striking the wall 50. The liquid flowing through the passage 70 may next move into an optional second quiet zone 74, downstream of the first quiet zone 58. The second quiet zone 74 may, as in the embodiment illustrated, be defined at an upstream side by the baffle 66 and at a downstream side by a second baffle 76. Again, a top end 78 of the second baffle preferably is higher than the level of the impact wall 50. The second quiet zone 74 merely provides an additional area where heavy and dense objects may settle out from the flow path. A second outlet passage 80 is provided between the top of the second baffle 78 and the top wall 68. Downstream of the second outlet passage 80 is an outlet 82 leading to a drain pump. When the drain pump is not operating, wash liquid is prevented from flowing through the outlet 82 and so the wash liquid passes further in the container 42, downstream to an outlet 84 leading to the recirculation pump.

A space 86 which communicates directly with the outlet 82 to the drain pump preferably has a large cross sectional area so that any relatively large, but light or low density objects, such as toothpicks, can easily pass through the area 86 to the drain outlet 82. An area 88 communicating with the outlet 84 to the recirculation pump, however, is constricted by a wall 90 which obstructs passage of relatively large objects into the recirculating pump outlet 84, thereby preventing such objects from being redistributed onto the fabric material being washed. Further, a filter mechanism 92 may be provided between the drain outlet 82 and the recirculating outlet 84 so as to capture and retain small or light objects, such as lint, to prevent such objects from being redistributed on to the fabric load.

During a drain portion of the cycle, wash liquid is drawn in through the inlet 44, as well as from the recirculation outlet 84, and thus is drawn in a reverse direction through the filter mechanism 92, thereby self cleaning the filter mechanism and causing any collected material to be dispensed through the outlet 82 to the drain.

Figure 3:
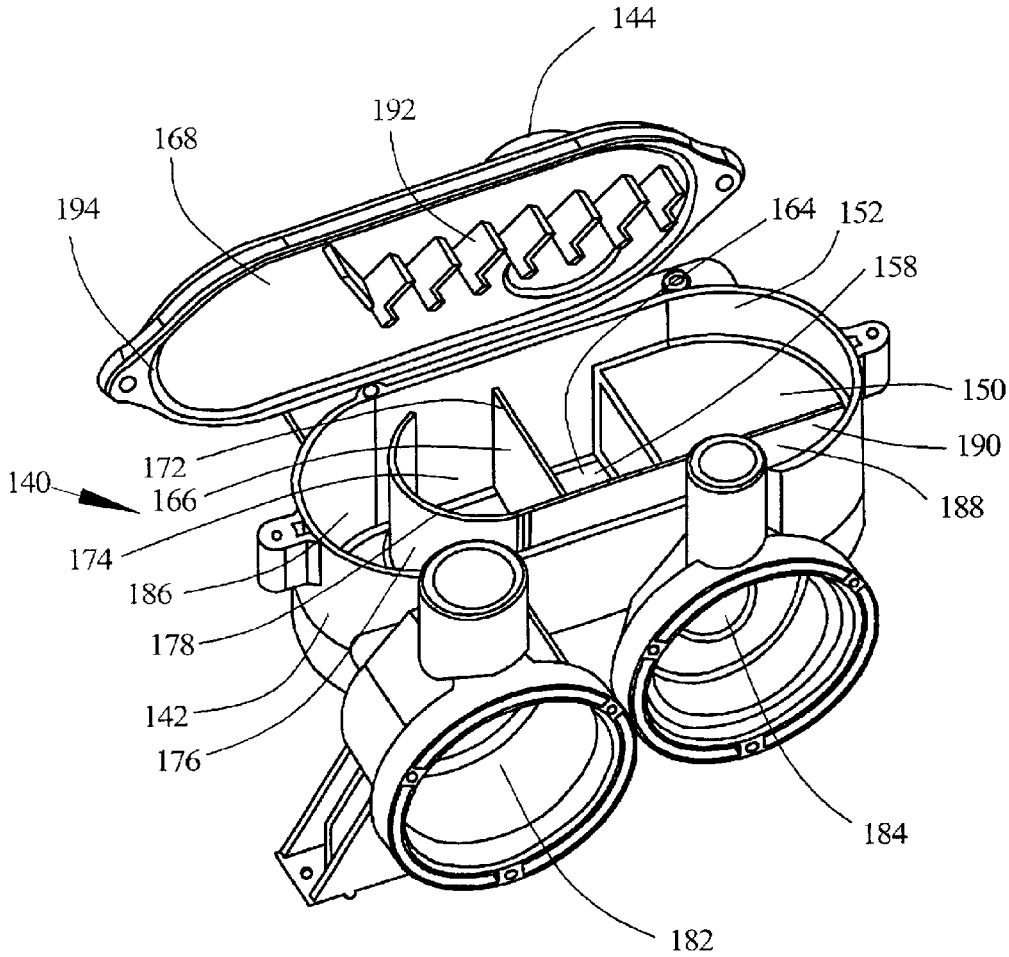
FIG. 3 is a perspective view of a lint filter and foreign objects trap embodying the principles of the present invention.

A particular commercial embodiment of the invention is illustrated in FIG. 3 which shows a foreign objects trap 140 in an open condition to allow visualization of interior components. A foreign objects trap 140 includes a container 142 having an inlet 144 which passes through a top wall 168 of the container. The inlet 144 is positioned directly over a wall 150 which is arranged perpendicular to, and closely adjacent to the inlet 144 and defines an inlet chamber 152. Downstream of the inlet chamber is a first quiet zone 158 which is substantially deeper than the inlet chamber 152 and includes a floor 164 which forms a bottom of the container 142. A first baffle 166 defines a downstream edge of the first quiet zone 158 and has a top edge 172 with an elevation greater than the impact wall 150. Downstream of the first baffle 166 is a second quiet zone 174 defined between the first baffle 166 and a second baffle 176. Again, a top edge 178 of the second baffle 176 is positioned above the level of the impact wall 150.

Downstream of the second baffle 176 is an area 186 which communicates with an outlet 182 leading to the drain pump. Farther downstream, within the container 142, is an outlet 184 which leads to the recirculation pump. An area 188 which communicates with the recirculation pump outlet 184 is reduced in its cross sectional dimension compared to the area 186 due to the position of a wall 190 which confines the area. Positioned between the outlet 182 to the drain pump and the outlet 184 to the recirculation pump is a filter mechanism 92 which, in the embodiment illustrated, is a series of fins depending downwardly from the top wall 168 which extend into the flow path of the liquid being directed to the recirculation pump outlet 184 and positioned to capture any light or low density foreign objects which would be carried along near the top of the flow path. The fins are shown as being positioned in an angled orientation relative to the flow path so as to provide a greater surface area for collecting any floating foreign objects.

In the embodiment of FIG. 3, the top wall 68 forms a removable cover which can be secured to the remainder of the container 142, such as by threaded fasteners, and includes a seal 194 to prevent leakage between the cover and the remainder of the container.

As a further enhancement for either embodiment, a heating element 96 (FIG. 2) can be provided inside of the container 42, such as positioned on the floor 64, in either or both of the quiet zones 58, 74, on a vertical wall, such as baffle 66, and/or on the top wall 68, or the heater element 96 can be arranged in an elevated position at any location within the container 42. In this manner, the heating element can be removed from its typical location in the sump of the washer, thereby allowing the sump to be dramatically reduced in size, or eliminated all together, thus reducing a volume of water held in the wash tub which is not currently being utilized to treat the fabric in the wash tub. This can lead to reduced water consumption by the washer.

By providing the heating element 96 in the foreign objects trap container 42, it will be assured that the heating element is always submerged in wash liquid, thereby preventing a situation where the element is exposed which could lead to overheating.

In a preferred arrangement, the heating element 96 can take the form of a film heater which can be applied directly to one of the walls of the container 42 or which can be molded together with the material forming the container 42 which would allow the container 42, now acting as a remote sump, to retain its compact features while still incorporating the heater. The film heater may be in the form of a resistive element which is printed by silk screening or other similar processes into a desired pattern on one or more of the interior walls of the container 42.

The top wall 68 may also include an air dome 97 which retains a volume of air, even when the container 42 is filled with wash liquid. The air dome could include a pressure sensor 98 which can be used to determine water levels or possible flood condition in the wash tub. By providing the pressure sensor 98 in the foreign objects trap container 42 helps to reduce costs for the pressure sensing function.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A foreign objects trap for an automatic washer, wherein the washer has a wash tub with an outlet at a bottom thereof leading to a recirculation pump and a drain pump, said trap comprising a container having:

a liquid inlet in communication with said tub outlet for defining an initial flow path for wash liquid from said wash tub into said container;

a first wall positioned substantially perpendicular to said initial flow path closely adjacent to and downstream of said inlet and defining a portion of an inlet chamber, at least one quiet zone downstream of said inlet chamber comprising a cross sectional area perpendicular to said flow path in excess of a cross sectional area of said liquid inlet, at least one baffle downstream of said quiet zone, said baffle extending upward from a floor of said container, an outlet leading to said drain pump downstream of said at least one baffle, and an outlet leading to said recirculation pump downstream of said at least one baffle.

2. A foreign objects trap according to claim 1, wherein said outlet leading to said recirculation pump is located downstream of said drain pump outlet.

3. A foreign objects trap according to claim 1, including an air dome in a top wall of said container and a pressure sensor positioned in said air dome.

4. A foreign objects trap according to claim 1, including a second quiet zone downstream of said at least one baffle and a second baffle downstream of said second quiet zone.

5. A foreign objects trap according to claim 1, including an obstruction wall positioned closely adjacent, but spaced from said recirculation pump outlet.

6. A foreign objects trap according to claim 1, including a filter mechanism positioned between said outlet leading to said drain pump and said outlet leading to said recirculation pump.

7. A foreign objects trap according to claim 6, wherein said filter mechanism comprises fins extending from a top wall of said container.

8. A foreign objects trap according to claim 1, including a heater element positioned in the liquid flow path in said container.

9. A foreign objects trap according to claim 8, wherein said heater element comprises a heater film located on said floor of said container.

10. A foreign objects trap for an automatic washer, wherein the washer has a wash tub with an outlet leading to a recirculation pump and a drain pump, said trap comprising a container having:

a water inlet in communication with said tub outlet for defining an initial flow path for wash liquid from said wash tub into said container, a first wall positioned in an impact orientation relative to said initial flow path downstream of said inlet, at least one quiet zone downstream of said first wall, at least one baffle downstream of said quiet zone, said baffle extending substantially perpendicular to a direction of flow of said wash liquid, an outlet leading to said drain pump downstream of said at least one baffle, and an outlet leading to said recirculation pump downstream of said at least one baffle.

11. A foreign objects trap according to claim 10, wherein said first wall is oriented perpendicular to said initial flow path.

12. A foreign objects trap according to claim 10, wherein said first wall causes said wash liquid in said initial flow path to change direction.

13. A foreign objects trap according to claim 10, wherein said quiet zone is defined between said first wall and said baffle.

14. A foreign objects trap according to claim 10, wherein said baffle extends upwardly from a bottom wall of said container.

15. A foreign objects trap according to claim 10, wherein said outlet leading to said recirculation pump is downstream of said outlet leading to said drain pump.

16. A foreign objects trap according to claim 10, including an obstruction wall positioned closely adjacent to said outlet leading to said recirculation pump to prevent foreign objects of a predetermined size from reaching said recirculation pump outlet.

17. A foreign objects trap according to claim 10, wherein said outlet leading to said recirculation pump is located downstream from said outlet leading to said drain pump and including a filter mechanism positioned between said outlet leading to said drain pump and said outlet leading to said recirculation pump.

18. A foreign objects trap according to claim 10, including a heater element positioned in the wash liquid flow path in said container.

19. A foreign objects trap according to claim 18, wherein said heater element comprises a heater film located on said floor of said container.

20. A foreign objects trap for an automatic washer, wherein the washer has a wash tub with an outlet leading to a recirculation pump and a drain pump, said trap comprising a container having:

a wash liquid inlet in communication with said tub outlet for defining an initial flow path for wash liquid from said wash tub into said container;

a first wall positioned substantially perpendicular to said initial flow path and closely adjacent to said wash liquid inlet, at least one quiet zone downstream of said first wall and comprising an enlarged cross sectional flow path area, at least one baffle downstream of said quiet zone, said baffle extending upwardly from a floor of a flow path area, an outlet leading to said drain pump downstream of said at least one baffle, an outlet leading to said recirculation pump downstream of said outlet leading to said drain pump, and a filter mechanism positioned between said outlet leading to said drain pump and said outlet leading to said recirculation pump.

21. A foreign objects trap for an automatic washer, wherein the washer has a wash tub with an outlet leading to a recirculation pump and a drain pump, said trap comprising a container having:

a wash liquid inlet in communication with said tub outlet, an impact wall downstream of said inlet, a quiet zone downstream of said impact wall, a baffle downstream of said quiet zone, an outlet leading to said drain pump downstream of said at least one baffle, an outlet leading to said recirculation pump downstream of said at least one baffle, and a heater element positioned in a wash liquid flow path in said container between said wash liquid inlet and said outlet leading to said recirculation pump.

22. A foreign objects trap according to claim 21, wherein said heater element comprises a heater film located on a floor of said container.

* * * * *